United States Patent [19]

Deelen

[11] 3,968,750

[45] July 13, 1976

[54] PROJECTILE-CASE CONNECTION

[75] Inventor: Antonius Maria Deelen, Schijndel, Netherlands

[73] Assignee: Nederlandsche Wapen- en Munitiefabriek "De Kruithoorn" B.V., 's-Hertogenbosch, Netherlands

[22] Filed: Aug. 14, 1974

[21] Appl. No.: 497,286

Related U.S. Application Data

[63] Continuation-in-part of Ser. No. 342,988, March 20, 1973, abandoned.

[52] U.S. Cl. ..... 102/41; 102/43 P; 102/92.7

[51] Int. Cl.[2] ..... F42B 9/20

[58] Field of Search ..... 102/41, 43, 92.7, 93

[56] References Cited

UNITED STATES PATENTS

| | | | |
|---|---|---|---|
| 2,911,911 | 11/1959 | White | 102/93 |
| 3,242,865 | 3/1966 | Jungermann et al. | 102/41 |
| 3,749,020 | 7/1973 | Weyhmuller | 102/93 |

FOREIGN PATENTS OR APPLICATIONS

| | | | |
|---|---|---|---|
| 705,644 | 3/1965 | Canada | 102/93 |
| 1,283,123 | 11/1968 | Germany | 102/92.7 |

*Primary Examiner*—Verlin R. Pendegrass
*Attorney, Agent, or Firm*—Walter Becker

[57] ABSTRACT

Means for securing a projectile to the case thereof in a round of disintegrating practice ammunition for artillery pieces having high rates of fire, in which the shell of the projectile of synthetic material is inserted into the case by an end portion. The end portion of the projectile is provided with one or more recesses. A fluid self-hardening resin is brought into the space between the wall of the case and the projectile to fix the projectile in the case before firing.

1 Claim, 1 Drawing Figure

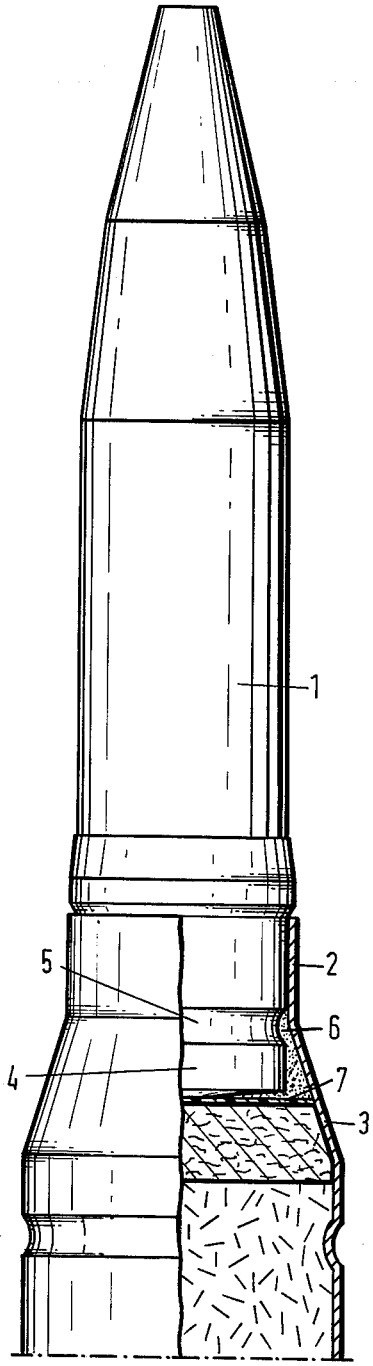
1
2
3
4
5
6
7

PROJECTILE-CASE CONNECTION

This is a continuation-in-part of co-pending application S.N. 342,988-Deelen filed Mar. 20, 1973 now abandoned.

This invention relates to means securing a projectile to a neck portion of the case in fixed ammunition, and in particular in disintegrating practice ammunition for artillery pieces having high rates of fire.

Disintegrating practice ammunition, commonly referred to as "Break-up Shot," is ammunition which can be loaded as normal ammunition and fired automatically at a high rate and the projectile of which, after having left the gun barrel, disintegrates into fragments a short distance from the muzzle. This type of practice ammunition generally employs a projectile having an outer shell of plastic material which is filled with one or more bodies of compressed metallic powder or with loose metallic powder, or with a combination of both. Disintegration of the outer shell and its contents into fragments results from centrifugal force to which the projectile is subjected after having left the gun barrel.

With the trend of producing guns with increasingly higher rates of automatic fire, the demands made on the robustness of such ammunition become progressively more severe. Rounds of disintegrating practice ammunition are loaded at extremely high rates so that during loading the rounds are subjected to a high rate of acceleration and a severe deceleration (almost to a "dead-stop") when fully rammed into the breech. These conditions subject the projectile and the case to extreme physical loads and especially in the region in which the projectile is secured in the case.

In automatic guns having a high rate of fire, the region of connection between the projectile and the case is subjected to very severe inertial forces during the previously described loading procedure. These inertial forces are dependent on the mass of the projectile and the rate of fire of the gun, that is to say on the acceleration and deceleration of the projectile. With increasing diameters of calibre of the barrel an increase occurs in the ratio of the mass of the projectile divided by its diameters, so that the inertial forces imposed thereon become even more critical in the region of the connection between the projectile and the case in which it is secured. As a consequence many of the conventional connections between projectile and case therefor are unsuitable for firing the rounds in fast firing automatic guns.

The present invention therefore is directed toward the elimination of disadvantageous characteristics manifesting themselves in the known conventional connections between the projectile and its case in disintegrating practice ammunition.

According to the invention, there is provided:

In ammunition, in particular disintegrating practice ammunition for automatic guns having a high rate of fire, comprising a projectile having an end portion with at least one annular recess therein mounted in a neck portion of a case for said projectile; a securing means accommodated in, and at least substantially filling, the space defined between the recessed end portion of said projectile and a conical part of said neck portion of the case therefor, said securing means being formed of a material which is not substantially plastically deformable.

The securing means, according to the invention, is preferably manufactured from a castable self-setting synthetic resin.

The invention will be better understood from the following description, read with reference to the accompanying drawing.

In said drawing an end portion of a projectile 1 is shown inserted into the neck 2 of a cartridge case thereof. This end portion 4 of the projectile is provided with an annular recess 5. The space between the internal surface of the conically formed shoulder 3 of the case and the annular recess 5 in the lower end of the projectile 1 is filled with a liquid self-hardening synthetic resin (or) (adhesive) 6. This resin (or adhesive material) is poured into the neck 2 of the case onto, for example, a partition of felt which seals off the charge in the case before insertion of the projectile 1. Thereafter the projectile 1 is pressed into the neck 2 of the case and the assembly is turned upside down such that the liquid filling assumes a complementary pattern of the end of the projectile which it surrounds, through its ability to easily flow between the internal conically formed surface of the shoulder 3 of the case and the annular recess 5 of the projectile 1 and thereafter harden out.

An attendant advantage of this construction is that a greater rigidity against lateral stresses on the projectile 1 is obtained.

With the new cartridge according to the present invention, the projectile consists of an outer shell of plastic material, which is filled with one or more bodies of compressed or loose metallic powder and disintegrates after firing. The plastic material of the shell body is relatively soft and can easily be twisted.

In practice the plastic resin only surrounds the bottom end of the shell.

The drawing illustration shows the actual shape of the hardened adhesive ring.

The present invention concerns a way of securing a projectile with an outer shell of a relatively soft plastic material by pouring a self-hardening resin into the case and then inserting the tail end of the projectile into the case so that the resin will fill the annular groove and stick to the inner wall of the cartridge case before hardening. The self-hardening resin is not deformable.

The method of mounting the projectile in the case is as follows:

In a cartridge case filled with a propellant charge covered with a layer of felt and a thin cover plate a small amount of fluid resin is poured on the cover plate. Then the bottom end of the projectile is inserted into the case until the driving band rests on the case neck. Now the cartridge is turned upside down to let the fluid resin flow into the space between the annular recess (5) in the end portion of the projectile and the conical shoulder part (3) of the cartridge case. The resin thereby sticks firmly to the metal case and gets hard after which it is not deformable anymore. When the round is fired, the hard resin ring sticks to the case wall, and the relatively soft bottom end of the shell is deformed while it slips out of the ring.

The self-setting resin used in this process is "a two-component glue based on epoxy resin," in German "polystyrolkleber" (Kleber = glue).

Although the foregoingly described connection for a projectile and the case therefor is particularly destined for use with disintegrating practice ammunition, it can be adapted for use with other types of ammunition.

We claim:

1. In ammunition, in particular disintegrating practice ammunition for artillery pieces having a high rate of fire, comprising in combination a projectile having a relatively soft deformable plastic material shell having an end portion formed with at least one annular recess therein, a cartridge case open at one end and receiving said end portion, said case having a conical part extending rearwardly and surrounding said annular recess, and means for securing the shell to said cartridge case comprising hardened, molded material filling the space between said recess and said conical part.

* * * * *

UNITED STATES PATENT OFFICE

CERTIFICATE OF CORRECTION

PATENT NO. : 3,968,750

DATED : July 13, 1976

INVENTOR(S) : Antonius Maria Deelen

It is certified that error appears in the above-identified patent and that said Letters Patent are hereby corrected as shown below:

On the Title Page, Item [30] should read

Netherlands 7203827 March 22, 1972

Signed and Sealed this

Twenty-ninth Day of March 1977

[SEAL]

*Attest:*

RUTH C. MASON
*Attesting Officer*

C. MARSHALL DANN
*Commissioner of Patents and Trademarks*